US007713100B2

(12) United States Patent
Hernandez et al.

(10) Patent No.: US 7,713,100 B2
(45) Date of Patent: May 11, 2010

(54) MALE ELECTRICAL TERMINAL WITH A TWISTED CONTACT SECTION

(75) Inventors: Stéphane Hernandez, Chaville (FR); François Cormier, Senantes (FR); Pascal Guillet, Luisant (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 11/989,058

(22) PCT Filed: Jul. 21, 2005

(86) PCT No.: PCT/EP2005/009448

§ 371 (c)(1),
(2), (4) Date: Jul. 20, 2009

(87) PCT Pub. No.: WO2007/009487

PCT Pub. Date: Jan. 25, 2007

(65) Prior Publication Data

US 2009/0305582 A1 Dec. 10, 2009

(51) Int. Cl.
*H01R 9/24* (2006.01)
*H01R 13/02* (2006.01)

(52) U.S. Cl. ..... 439/884; 439/850; 439/866

(58) Field of Classification Search ..... 439/884, 439/849, 850, 852, 866, 845, 877
See application file for complete search history.

(56) References Cited

U.S. PATENT DOCUMENTS

| | | | | |
|---|---|---|---|---|
| 4,009,927 | A * | 3/1977 | Knowles | 439/682 |
| 5,989,080 | A | 11/1999 | Tsuji et al. | 439/884 |
| 6,551,151 | B2 * | 4/2003 | Suzuki | 439/877 |
| 6,638,117 | B2 * | 10/2003 | Murakami et al. | 439/849 |
| 6,866,551 | B2 * | 3/2005 | Murakami et al. | 439/884 |
| 2004/0127108 | A1 | 7/2004 | Ferre Giro et al. | 439/891 |

FOREIGN PATENT DOCUMENTS

| | | |
|---|---|---|
| EP | 0 821 435 A2 | 1/1998 |
| EP | 1 278 269 A2 | 1/2003 |
| WO | WO 2007009487 A1 * | 1/2007 |

* cited by examiner

*Primary Examiner*—Hae Moon Hyeon
(74) *Attorney, Agent, or Firm*—Harrington & Smith

(57) ABSTRACT

This terminal includes a folded contact section which has a longitudinal junction line and defines contact surfaces, a securing section, suitable to be accommodated in a terminal accommodating chamber of an insulating housing, and an intermediate section extending between said contact section and securing section. The intermediate section is deformed in torsion around the longitudinal axis (X), whereby the junction line is angularly offset from the contact surfaces around the longitudinal axis (X). The invention also relates to a process for manufacturing such a terminal, and to an electrical connector including such a terminal.

7 Claims, 4 Drawing Sheets

MALE ELECTRICAL TERMINAL WITH A TWISTED CONTACT SECTION

BACKGROUND OF THE INVENTION

The invention relates to a male electrical terminal which is elongated along a longitudinal axis, integrally made from a metal sheet, and which comprises

- a folded contact section which has a longitudinal junction line between two edges of the corresponding portion of the metal sheet, said contact section defining contact surfaces to be engaged by complementary contact surfaces of a complementary female terminal,
- a securing section, suitable to be accommodated in a terminal accommodating chamber of an insulating housing, and to be engaged by a locking member of said housing so as to secure the terminal in said chamber, and
- an intermediate section extending between said contact section and securing section.

Prior art terminals of this type are conventionally used in such an orientation in the connector housings that the contact surfaces are partially located on the junction line. In fact, the orientation of the terminal in the housing, and thus the location of the contact surfaces, is determined by the orientation of the securing section.

The contact surfaces provided by terminals of this type have discontinuities due to the junction lines, which are prejudicial to the conduction performances.

SUMMARY OF THE INVENTION

It is an object of the invention to solve this problem and provide a male electrical terminal with improved conduction performances, with no influence on the orientation of the securing section in the connector housing, and no need of modification of the latter.

Accordingly, the invention provides a male electrical terminal of the above-type, wherein the intermediate section is deformed in torsion around the longitudinal axis, whereby the junction line is angularly offset from the contact surfaces around the longitudinal axis.

The invention also relates to a process for manufacturing such a terminal, and to an electrical connector including such a terminal.

The invention will be better understood on reading the following description of one particular embodiment of the invention, given as a non-limiting example.

DETAILED DESCRIPTION OF ONE PREFERRED EMBODIMENT

A male electrical terminal according to the invention is shown on the FIGS. 1-4.

This male terminal 1 is of a type suitable to be crimped at one end of an electrical cable, and to be accommodated in the insulating housing (not shown) of a multi-way connector.

More specifically, this terminal is suitable for electrical connectors used in automotive applications.

Figure 4:
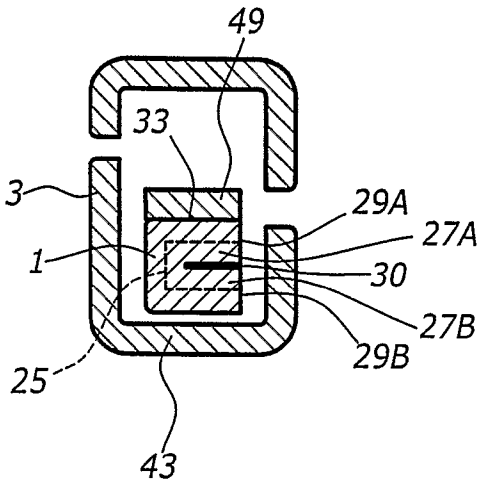
FIG. 4 is a cross-sectional view of the male terminal in the plane 4-4 indicated on FIG. 3.
Figure 3:
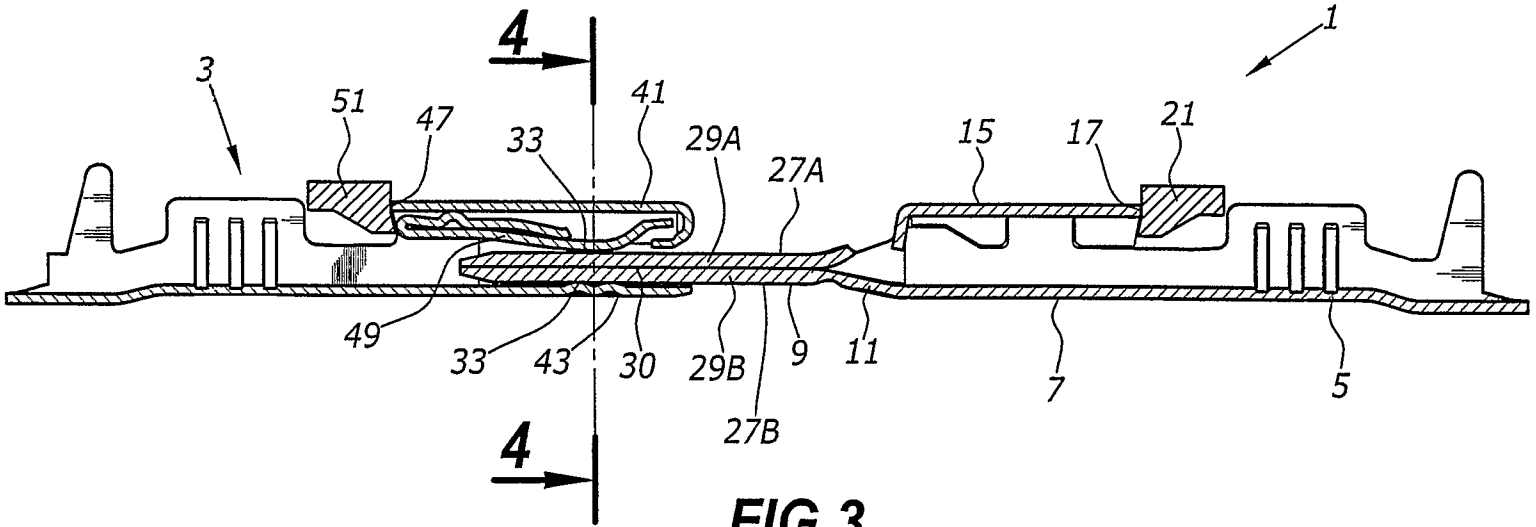
FIG. 3 is a cross-sectional view, in a median longitudinal plane, of the male terminal of FIGS. 1 and 2 in a mated position with a complementary female terminal.

The male terminal 1 is suitable to mate with a female terminal 3, as shown on FIGS. 3 and 4.

The terminal 1 is elongated along a longitudinal axis X, which also represents the mating direction attached to the terminal 1. The X-axis is oriented from the male terminal 1 towards the female terminal 3 in mating conditions.

The orientation or position terms used in the present description and related to the male terminal 1, in particular the terms "forward" or "front", refer to this mating axis X.

The terminal 1 is integrally made from a metal sheet (or blank), essentially by successive operations of stamping and folding.

The terminal 1 essentially has, extending successively in the longitudinal X-axis from the rear to the front, a crimping section 5, a securing section 7, and a contact section 9. It also has an intermediate section 11 extending between the securing section 7 and the contact section 9.

Figure 1:
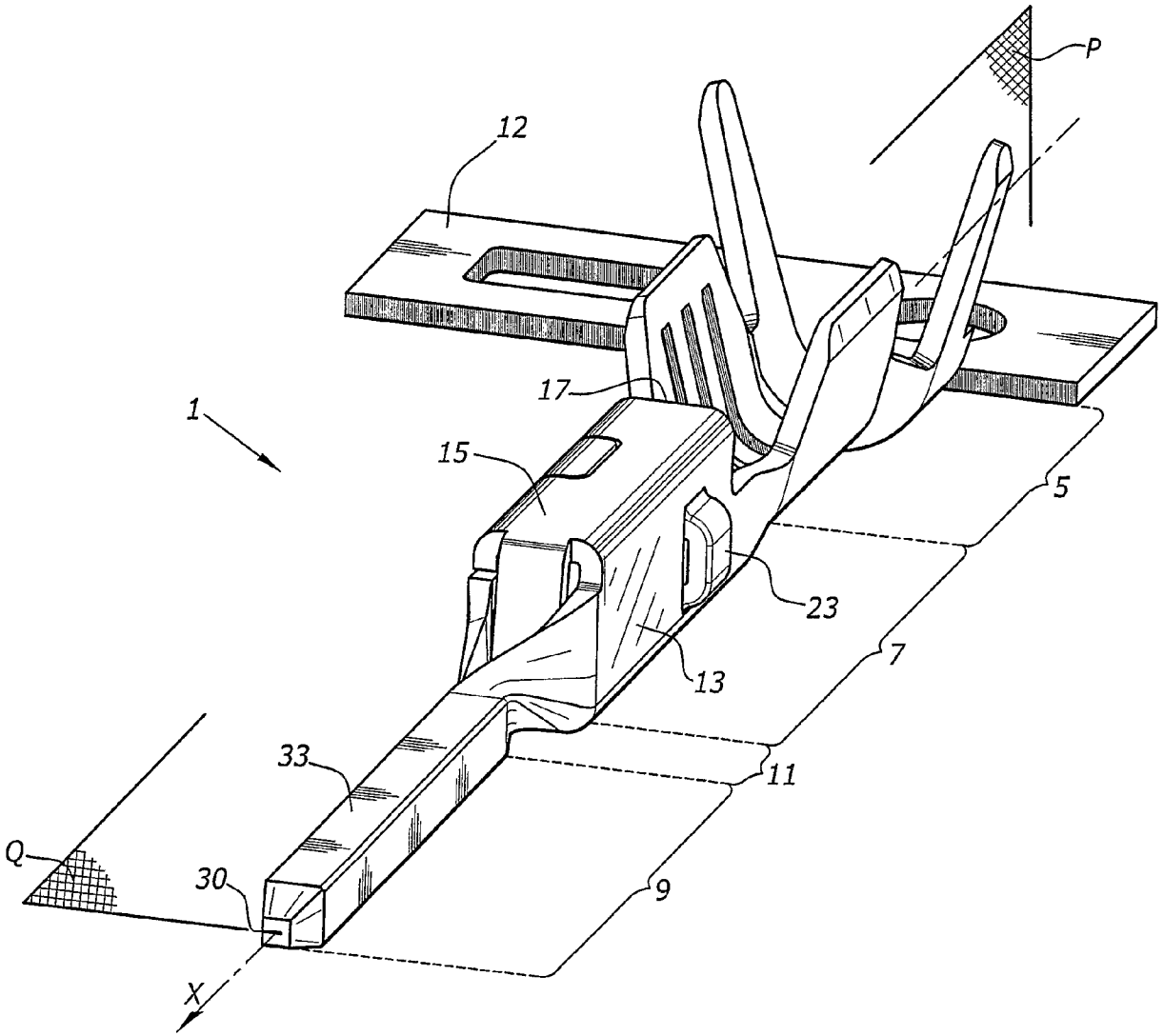
FIG. 1 and FIG. 2 are perspective views, in two different directions, of a male terminal according to one embodiment of the invention.
Figure 2:
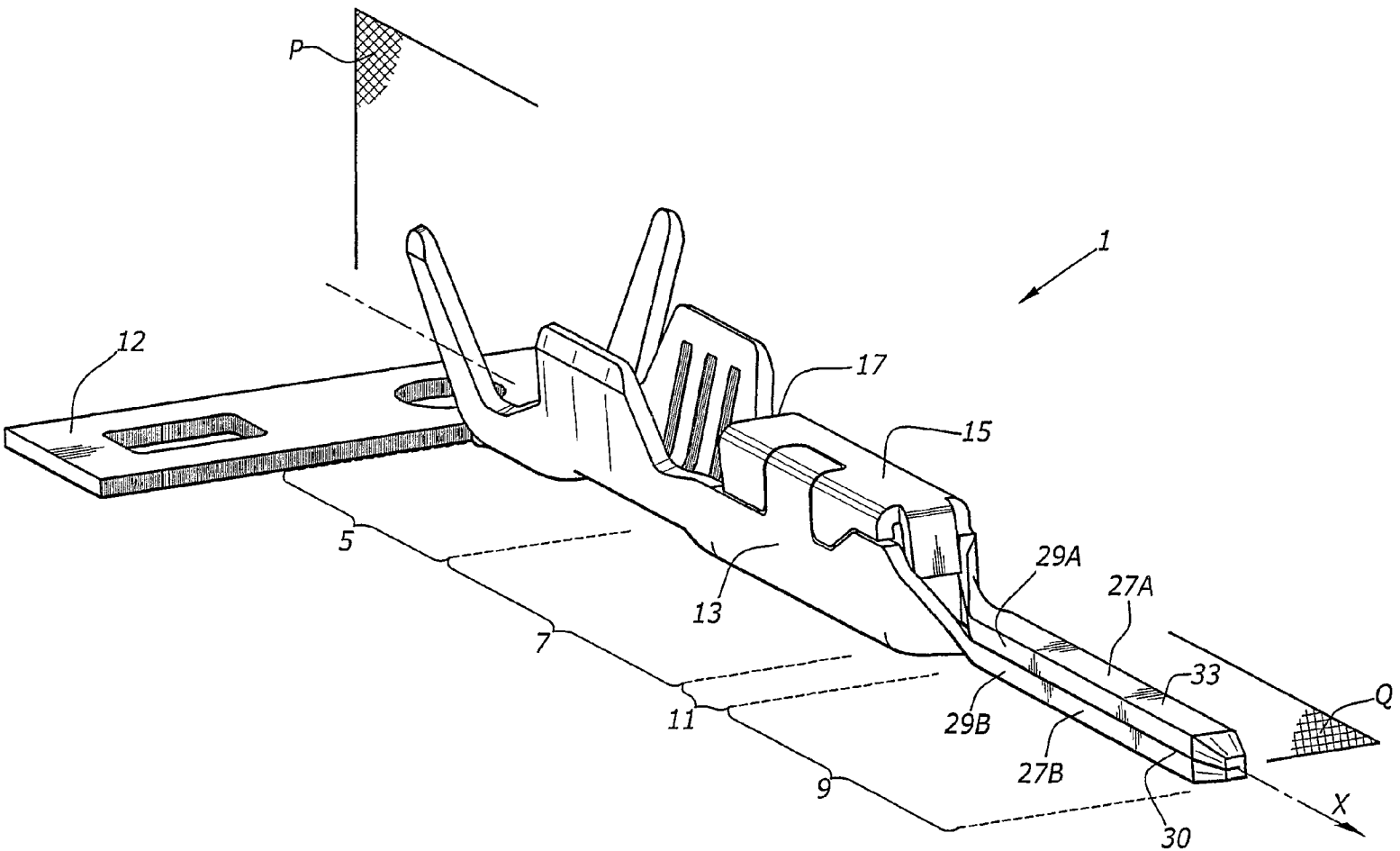

On FIGS. 1 and 2, the male terminal 1 is shown attached on a metal stripe 12 and integrally made therewith from the metal sheet. Of course, this stripe 12 is not part of the terminal, but is conventionally used to drive the blank through the tools during the manufacturing process and to attach together the series of terminals being processed.

The crimping section 5 is substantially U-shaped in cross-section (in a plane perpendicular to the X-axis), and substantially symmetrical with respect to an axial plane P, which will be supposed vertical in the following.

The above description of the crimping section 5, and more generally any further description of the section 5, is made for an initial state of the terminal, before crimping of the terminal on the wire.

In other embodiments, the crimping section could be replaced by any other suitable type of wire connecting section.

The securing section 7 is substantially box-shaped (parallelepipedic), with four longitudinally extending lateral walls, that is two opposed vertical walls 13 and two opposed horizontal walls 15.

The securing section 7 is provided to be accommodated and secured in a chamber of the insulating housing of an electrical connector. To this purpose, the securing section 7 has a rear stop edge 17 provided to be engaged by a locking member, such as a flexible arm, of the connector housing.

The locking member is partially shown in section on FIG. 3, with the reference numeral 21, in the engaged position with the stop edge 17, whereby FIG. 3 schematically illustrates the fully inserted and secured position of the male terminal 1 in the connector housing (represented by the locking arm 21).

It should be noted that, in an alternative embodiment (not shown), the securing section may have a recess or a window formed therein, provided to be engaged by a projecting tooth of a locking arm, in order to secure the terminal in the respective accommodating chamber.

In the example shown, the securing section 7 is also adapted to guide and orientate the terminal 1 upon its insertion in the housing. To this end, the securing section 7 has a guide and orientation member 23 outwardly projecting from one lateral wall 13, and integrally formed therewith by stamping.

The contact section 9 is made as a pin, with an outer shape rectangular in cross-section. As more visible on FIG. 4, the pin 9 is further generally U-shaped in cross-section, considering the median line 25 of the metal sheet (dotted line on FIG. 4), and symmetrical with respect to a horizontal longitudinal plane Q (FIGS. 1 and 2).

The pin 9 is formed by folding the corresponding portion of the metal sheet along a longitudinal folding line, and applying both branches 27A, 27B of the U-shape one on the other.

One lateral face of the rectangular pin 9 is thus formed by the merging surfaces of the initially opposed edges 29A, 29B of the corresponding portion of the metal sheet, said surfaces 29A, 29B merging along a longitudinal junction line 30.

The contact section 9 defines contact surfaces 33 (FIGS. 3 and 4) engaged by complementary contact surfaces of the complementary female terminal 3, in the mated position of said contacts, as shown on FIGS. 3 and 4.

As visible on FIG. 1, the intermediate section 11, which connects the contact section 9 to the securing portion 7, is twisted around the X-axis. In other words, the intermediate section is permanently deformed in torsion around the X-axis from its folded configuration, where it substantially has a plane symmetry, and where its symmetry plane is vertical and identical to P.

In these conditions, the symmetry plane Q of the pin 9 is angularly offset from the symmetry plane P of the crimping section, around the longitudinal X-axis, and more specifically orthogonal to this plane P.

Due to the permanent deformation of the intermediate section 11, the junction line 30 is angularly offset around the X-axis from the contact surfaces 33, which are provided on the external lateral surfaces of the branches 27A, 27B.

In the example shown, the offset angle is equal to 90°.

Referring to FIGS. 3 and 4, it will be noted that the female terminal 3 has a box-shaped body 41 with a lower longitudinal wall 43 and a rear edge 47. The female terminal 3 also has a flexible contact blade 49 extending within the body 41.

The wall 43 and the blade 49 define the contact surfaces of the female terminal, and are suitable to receive the pin 9 therebetween with a contact pressure on the contact surfaces 33.

The terminal body 41 is accommodated in a chamber in a counterpart connector housing, and secured therein by means of a locking member 51 engaged with the rear edge 47, which are similar in function respectively to the locking member 21 and the edge 17.

In the configuration shown on FIGS. 3 and 4, the respective orientation of the terminals 1, 3 is such that the contact blade 49 and the lower wall 43 extend in a substantially horizontal manner, whereby the contact surfaces 33 extend horizontally on the external lateral faces of the branches 27A, 27B.

It will be appreciated that, in such a configuration, where one relative orientation of the terminals is imposed by the locking means 17, 21, 47, 51 of both terminals 1, 3, the contact surfaces 33 are not intersected by the junction line 30, since they are located on different faces of the pin 9.

This is due to the torsional deformation of the intermediate section 11, and provides improved continuous contact surfaces 33.

Figure 5:
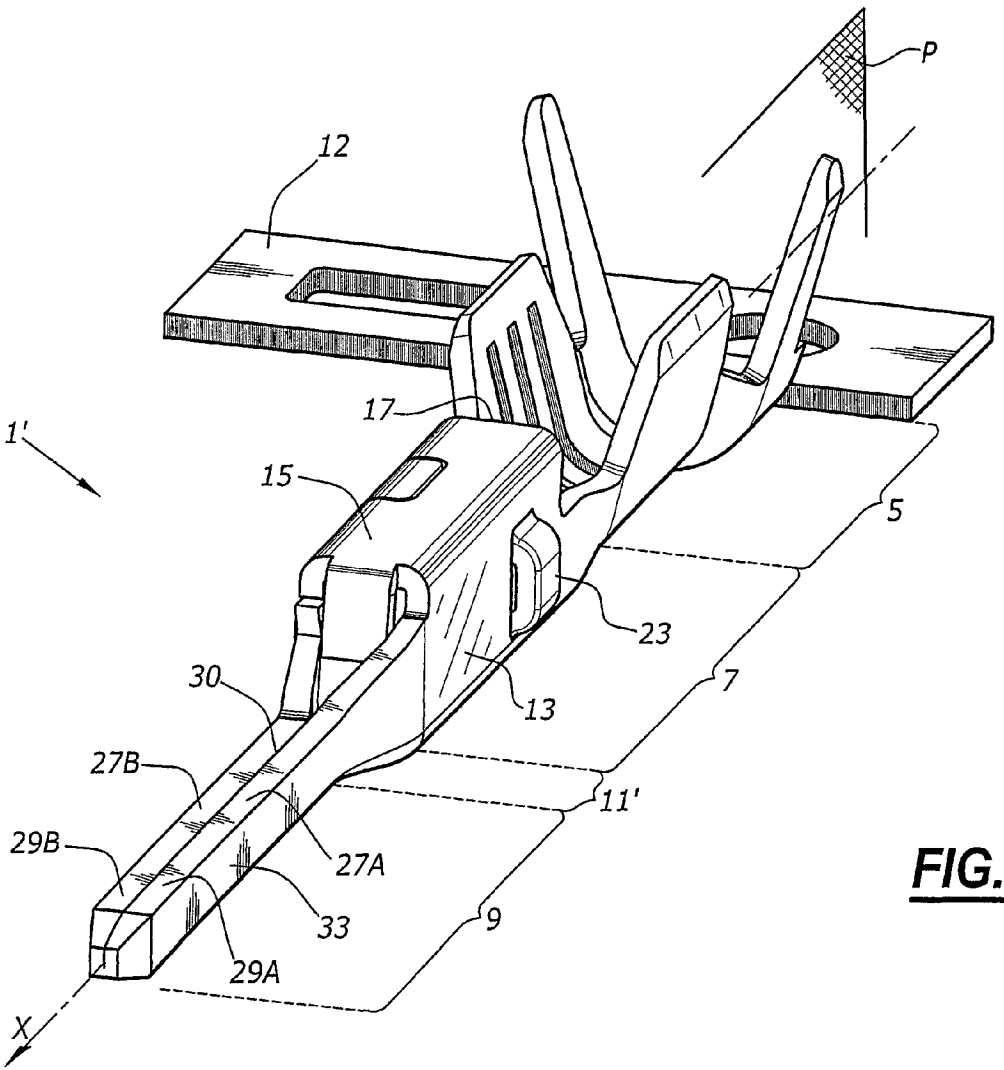
FIG. 5 is a similar view to FIG. 1, illustrating a former step of the manufacturing process of the male terminal shown on FIG. 1-4.

With reference to FIG. 5, the process for manufacturing a male terminal as shown on FIG. 1-4 will now be described.

In fact, FIG. 5 shows the female terminal of the invention in a prior state in the manufacturing process, the terminal in this state being identified by the reference numeral 1'.

In first successive steps of the manufacturing process, the blank is stamped and folded so as to form the terminal 1' in its non-twisted state, with the U-shaped crimping section 5, the box-shaped securing section 7, the U-shaped contact section 9, and the intermediate section in a non-deformed state (non-deformed in torsion around the X-axis). The non-deformed intermediate section is indicated with the reference numeral 11'.

The first steps of the process leading to the terminal 1' will not be further detailed since the terminal 1' may be itself of a conventional type, and these first steps may also be conventional.

It should be noted on FIG. 5, that the terminal 1' in its non-deformed state is generally symmetrical in outer shape with respect to the vertical axial plane P, and that the junction line 30 is then located in this symmetry plane P.

In a further step of the manufacturing process, the terminal 1' is deformed in torsion at its intermediate section around the longitudinal X-axis, so as to turn the pin 9 of a 90° offset angle with respect to the securing section 7. In this twisting (or torsion) step, the edges 29A, 29B are put in a vertical plane, that is parallel to the symmetry plane of the crimping section 5 and perpendicular to the stop edge 17 of the securing section 7.

The symmetry plane Q of the contact section 9 is then perpendicular to the symmetry plane P of the crimping section 5.

The invention claimed is:

1. A male electrical terminal which is elongated along a longitudinal axis (X), integrally made from a metal sheet, and which comprises a folded contact section which has a longitudinal junction line between two edges of the corresponding portion of the metal sheet, said contact section defining at least one contact surface to be engaged by at least one complementary contact surface of a complementary female terminal, a securing section, suitable to be accommodated in a terminal accommodating chamber of an insulating housing, and to be engaged by a locking member of said housing so as to secure the terminal in said chamber, and an intermediate section extending between said contact section and securing section, characterized in that said intermediate section is deformed in torsion around the longitudinal axis (X), whereby the junction line is angularly offset from the contact surfaces around the longitudinal axis (X).

2. The male electrical terminal as claimed in claim 1, characterized in that the contact section has a U-shaped cross-section which is substantially symmetrical with respect to a first longitudinal plane (Q).

3. The male electrical terminal as claimed in claim 2 , characterized in that it further comprises a wire connecting section which is substantially U-shaped in cross-section, said U-shape being substantially symmetrical with respect to a second longitudinal plane (P).

4. The male electrical terminal as claimed in claim 3, characterized in that the first longitudinal plane (Q) is angularly offset from the second longitudinal plane (P), around the longitudinal axis (X).

5. The male electrical terminal as claimed in claim 4, characterized in that the offset angle of said first (Q) and second (P) longitudinal planes is substantially equal to 90°.

6. An electrical connector comprising an insulating housing having at least one terminal accommodating chamber, and at least one male terminal as claimed in claim 1, the securing section of which is accommodated in said chamber.

7. A process for manufacturing the male electrical terminal as claimed in claim 1 from a metal sheet, said process comprising the following successive steps:

stamping and folding the metal sheet so as to form the contact section, the securing section, and the intermediate section, and deforming in torsion the intermediate section with respect to the securing section around the longitudinal axis (X).

* * * * *